US006857914B1

(12) United States Patent
Spaulding et al.

(10) Patent No.: US 6,857,914 B1
(45) Date of Patent: Feb. 22, 2005

(54) BATTERY POST CONNECTOR APPARATUS

(75) Inventors: James R. Spaulding, Macomb, MI (US); Todd E. Durocher, Warren, MI (US); Craig Rodriguez, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/768,299

(22) Filed: Jan. 30, 2004

(51) Int. Cl.[7] ..... H01R 4/48
(52) U.S. Cl. ..... 439/759
(58) Field of Search ..... 439/759, 772, 439/774

(56) References Cited

U.S. PATENT DOCUMENTS 1,633,176 A * 6/1927 Goeller ..... 439/202
3,256,511 A * 6/1966 Herrmann ..... 439/726
2001/0031585 A1 * 10/2001 Murakami et al. ..... 439/756

* cited by examiner

*Primary Examiner*—Phuong Dinh
(74) *Attorney, Agent, or Firm*—Laura C. Hargitt

(57) ABSTRACT

An apparatus for attaching an electrical cable to and making an electrical connection with a mounting post on a vehicle battery includes a base portion having an aperture extending through a first end and a second end thereof. The first end of the base portion is placed over the mounting post. An insert is received in the second end of base portion. A spring is received in the base portion and a cap having an open end sized to be placed over the base portion compresses the spring. At least one stop member is attached to the base portion. The stop member interacts with the cap to lock the cap in position with respect to the base portion when the spring is compressed, maintaining compression on the spring and the insert to ensure an electrical connection between the insert and the mounting post.

19 Claims, 3 Drawing Sheets

BATTERY POST CONNECTOR APPARATUS

BACKGROUND OF THE INVENTION

The present invention relates generally to connectors for automotive batteries and the like and, in particular, to a battery post connector apparatus.

Automobile batteries and battery connections are well known. Typical connections from the battery to the vehicle electrical system are a pair of cables respectively attached at either a top post connection or a side screw connection. For a typical automotive battery having a top post connection, the battery cable includes a cable terminal having a retaining nut thereon. The battery cable is secured to the battery post by positioning the cable terminal to the battery post and pressing downwardly until the entire connector is engaged onto the post. With a nut runner and a socket, the retaining nut is then driven to tighten the battery post connector until the joint is secure and to ensure proper conductivity from the battery post. This method of securing the battery cable to the battery post, however, disadvantageously requires that the operator have tool access to drive the retaining nut, which often presents a problem when designing the location for motor compartment components as available space in the engine compartment around the battery is often at a premium.

It is desirable, therefore, to provide an apparatus for connecting to a mounting location on a vehicle battery, such as a battery post or the like, that requires neither a great amount of space to make the connection nor requires assembly or disassembly tools.

SUMMARY OF THE INVENTION

An apparatus for attaching an electrical cable to and making an electrical connection with a mounting post on a vehicle battery includes a base portion having an aperture extending through a first end and a second end thereof. The first end of the base portion is placed over the mounting location. An insert is received in the second end of base portion. A spring is received in the base portion and a cap having an open end sized to be placed over the base portion compresses the spring against the insert. At least one stop member is attached to the base portion. The stop member interacts with the cap to lock the cap in position with respect to the base portion when the spring is compressed, maintaining compression on the spring and applying pressure to the insert to ensure an electrical connection between the insert and the mounting location.

In the present invention, the terminal to the battery post is engaged via spring tension, which firmly engages the terminal contacts to the battery posts. The connector contacts are designed to mimic the slope of the standard battery post. These contacts are under constant spring load and once engaged to the battery post utilize the entire conducting surface. This results in a constant and high strength contact to the battery post and ensures proper conductivity when under load while requiring no assembly or disassembly tools.

The apparatus in accordance with the present invention allows the assembly plant operator to install the battery post connector to the battery without the need for tools. This can be a distinct advantage when a battery is located in an area of the engine compartment that may offer interference to the tool. This will result in cost savings when the battery is installed. The apparatus in accordance with the present invention advantageously requires only that the operator have enough access to the battery post to position the connector and press downward (by hand) to engage the connector with the battery post.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
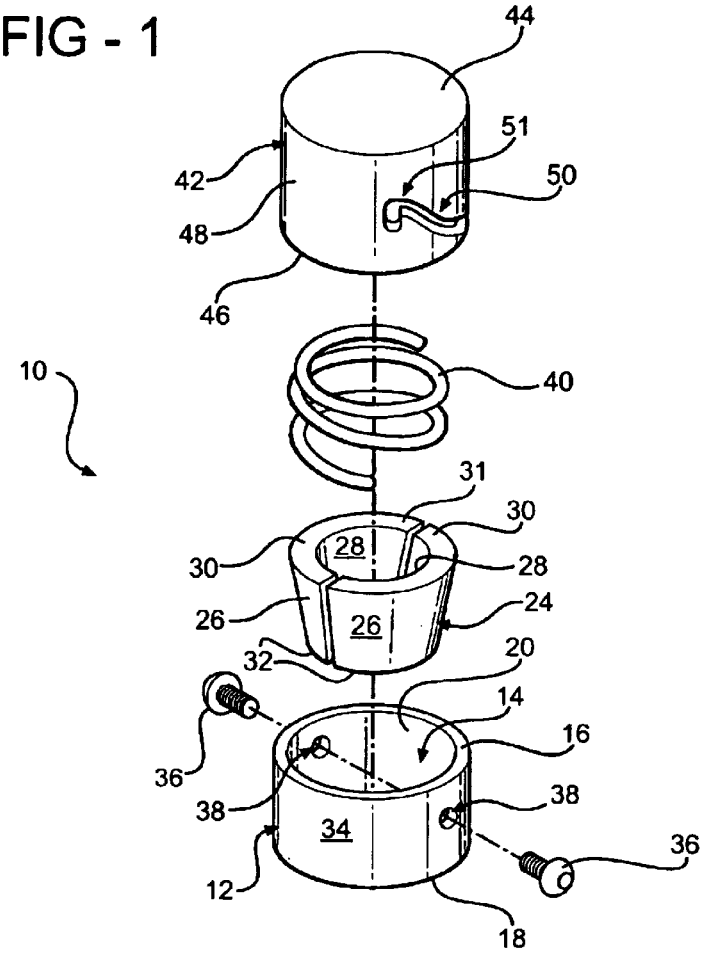
FIG. 1 is an exploded perspective view of a battery post connector apparatus in accordance with the present invention.
Figure 2:
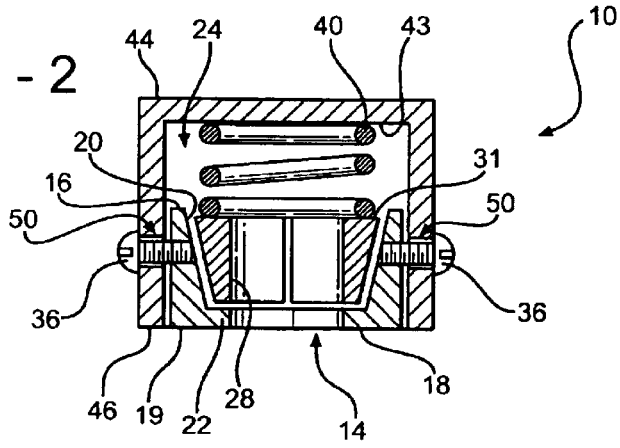
FIG. 2 is a cross-sectional view of the apparatus of FIG. 1 assembled.

Referring now to FIGS. 1 and 2, an apparatus for making an electrical connection between an electrical cable and a mounting location on a vehicle battery in accordance with the present invention is indicated generally at 10. The apparatus 10 includes a base portion 12 having an aperture 14 extending therethrough between a first end 16 and a second end 18 thereof. The aperture 14 defines an interior surface 20 that tapers inwardly from the first end 16 to a lip 22 adjacent the second end 18. The base portion 12 is preferably substantially cylindrical in shape and is adapted to receive an insert 24. The insert 24 is preferably a vertically split and substantially conical-shaped member. Preferably, the insert 24 is constructed of the same material as the battery post (typically lead), discussed in more detail below. Each half of the insert 24 includes an exterior surface 26 and an interior surface 28. Each of the exterior surfaces 26 tapers from an upper portion 30 to a lower portion 32 of the insert 24 and engages with the interior surface 20 of the base portion 12. The lower portion 32 of the insert 24 engages with the lip 22 of the base portion 12. Each of the interior surfaces 28 tapers inwardly from the lower portion 32 to the upper portion 30 of the insert 24 and engages with an exterior surface of a battery connector, discussed in more detail below. The insert 24 is preferably electrically connected to an electrical cable, discussed in more detail below.

An exterior surface 34 of the base portion 12 includes a pair of stop members 36 extending outwardly therefrom. Preferably, the stop members 36 extend in a direction substantially perpendicular to the exterior surface 34 and are located 180° apart along a circumference of the exterior surface 34. Preferably, the stop members 36 are attached to the exterior surface 34 by a threaded connection in the aperture 38, by a welded connection, or similar robust connection or attachment means. Alternatively, the stop members 36 are press fit into the corresponding apertures 38 formed in the exterior surface 34 of the base portion 12.

A spring 40 engages with an upper surface 31 of the insert 24 adjacent the upper portion 30 and with an upper interior surface 43 of a cap 42, best seen in FIG. 2. The cap 42 is generally cylindrical in shape and includes an upper end 44 and an open lower end 46. An outer surface 48 of the cap 42 includes a pair of grooves 50 formed therein for cooperating with a corresponding stop member 36 when the apparatus 10 is assembled, discussed in more detail below. Preferably, the grooves 50 extend at an angle to the axis of the cap 42 such that the respective ends of the grooves 50 are spaced apart vertically and horizontally along the of the outer surface 48. The vertical or travel length of the grooves 50 may be varied depending on the requirements of the apparatus 10, discussed in more detail below.

Figure 3A:
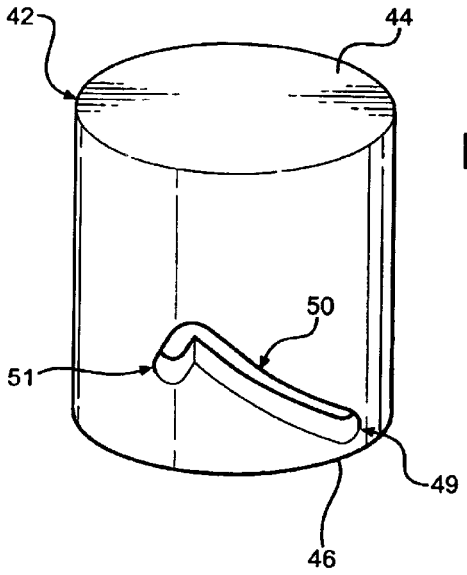
FIG. 3*a* is a perspective view of the cap of the apparatus shown in FIGS. 1 and 2.
Figure 3B:
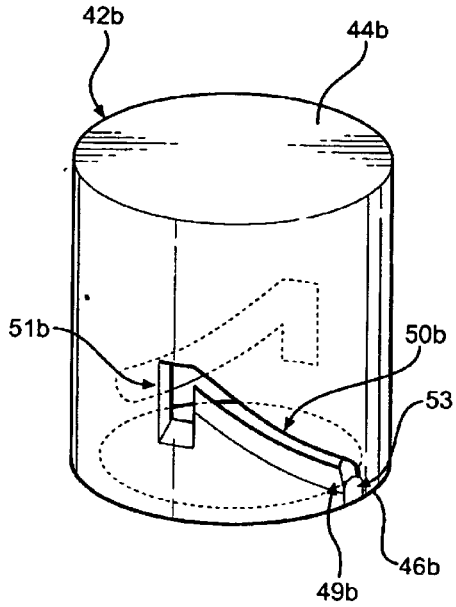
FIGS. 3*b* and 3*c* are perspective views similar to FIG. 3*a* of alternative embodiments of a cap for the battery post connector apparatus.
Figure 3C:
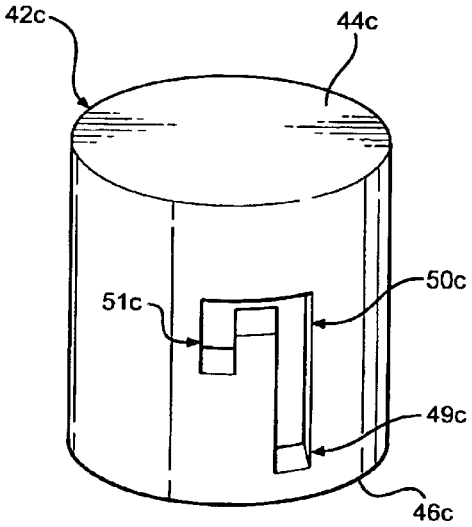

Referring now to FIGS. 3*a* through 3*c*, a number of embodiments of the cap 42 are shown in embodiments 42, 42*b*, and 42*c*, respectively. In FIG. 3*a*, the cap 42 is shown having the groove 50 formed therein that extends from a lower end 49 to an upper end 51. The upper end 51 includes a substantially vertical locking portion for locking the stop members 36 in place and preventing the stop members 36 from moving downwardly along the groove 51 towards the lower end 49 when the apparatus 10 is assembled, discussed in more detail below. In FIG. 3*b*, a lower end 49*b* of a groove 50*a* is open to allow the stop members 36 to pass therethrough. After the apparatus 10 is assembled and the stop member 36 is in the vertical locking portion of an upper end 51*b*, a block member 53 is placed in the open lower end 49*b* to prevent accidental disassembly of the apparatus 10. In FIG. 3*c*, a groove 50*c* extends from a lower end 49*c* to a locking portion of an upper end 51*c* in a substantially vertical direction.

The apparatus 10 is assembled by placing the insert 24 in the base portion 12, placing the spring 40 on an upper surface 31 of the insert 24, placing the cap 42 on the spring 40, compressing the spring 40 and inserting the stop members 36 into the apertures 38 and the grooves 50 to form the assembled apparatus 10 shown in cross section in FIG. 2.

Figure 4B:
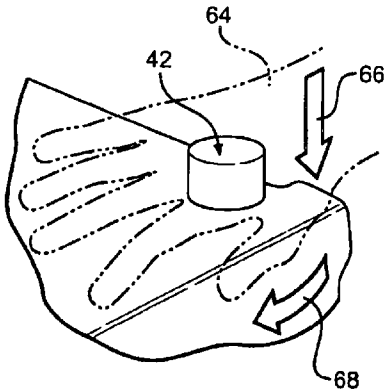
FIGS. 4*a* and 4*b* are perspective views of the apparatus of FIG. 1 shown adjacent a battery having a battery post.
Figure 4A:
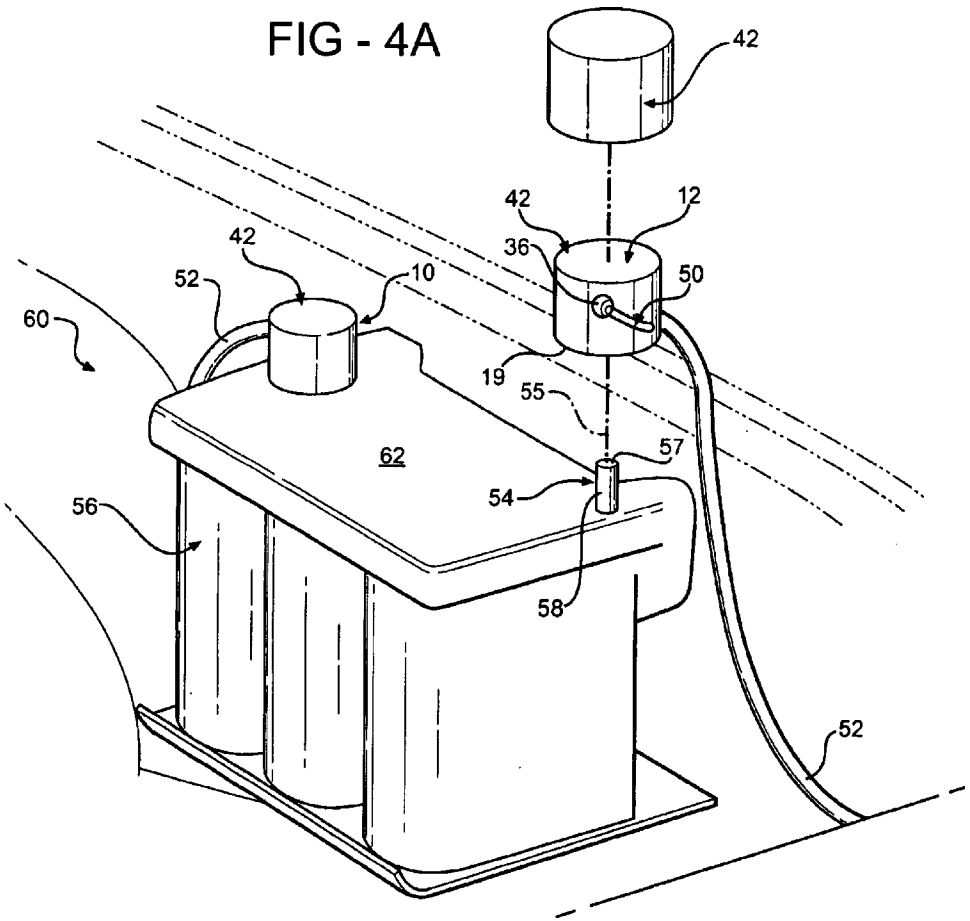

Referring now to FIGS. 4*a* and 4*b*, a partially assembled apparatus 10 is shown having an electrical cable 52 attached thereto. The end of the cable 52 attached to the apparatus 10 is electrically connected to the insert 24 (not shown) and the other end of the cable 52 connects to an electrical system (not shown), such as the electrical system of a vehicle. The assembled apparatus 10 includes the stop members 36 extending outwardly through the grooves 50 in the cap 42. The apparatus 10 is adapted to be attached to a post 54 on a vehicle battery 56. The battery post 54 is preferably formed of lead or a similar material includes an exterior surface 58, best seen in FIG. 4*a*. The battery 56 is located in a vehicle engine compartment, indicated generally at 60 and includes an upper surface 62. The exterior surface 58 of the battery post 54 typically has a larger diameter portion adjacent the upper surface 62 of the battery 56 and tapers to a smaller diameter portion on a free end 57 thereof. The tapered interior surfaces 28 of the insert 24 are designed to mimic this standard taper of the standard battery post 54.

The apparatus 10 is attached to the post 54 by an installer 64 placing the end 18 of the base portion 12 over an upper portion of the post 54. A lower surface 19 of the base portion 12 is placed adjacent or touching the upper surface 62 of the battery 56, after which, the cap 42 is pressed in a downward direction indicated by an arrow 66. The downward direction 66 is substantially parallel to a longitudinal axis 55 of the battery post 54. When the cap 42 is pressed in the downward direction 66, the spring 40 compresses, urging the interior surfaces 28 of the insert 24 against the exterior surface 58 of the post 54. As the installer 64 presses the cap 42 in the downward direction 66, the installer 64 also rotates the cap 42 in a clockwise direction indicated by an arrow 68. The direction 68 is dictated by the profile and shape of the grooves 50, 50*b* or 50*c* formed in the outer surface 48 of the cap 42 and may be a clockwise direction or counterclockwise direction. The installer 64 rotates the cap 42 in the direction 68 until the stop members 36 are disposed in a locked position, such as in the vertical locking portion in the ends 51, 51*b* or 51*c*. When attached, the apparatuses 10, the cables 52, and the battery 56 form a battery assembly.

In the locked position, the spring 40 remains compressed and the insert 24 is constrained between the lip 22 and an interior surface of the base portion 12, the exterior surface 58 of the post 54, and the spring 40. The spring 40, therefore, continually urges the interior surfaces 28 of the insert 24 against the exterior surface 58 of the post 54 and ensures a good electrical connection between the insert 24 and the post 54 to allow the battery 56 to provide voltage through the cable 52 to the electrical system.

The insert 24 utilizes the entire conducting surface between the interior surface 28 of the insert 24 and the length of the battery post 54. This connection results in a constant and high strength contact to the battery post 54 and ensures proper conductivity when under load while advantageously requiring no assembly or disassembly tools.

Alternatively, a lip (not shown) extends radially inwardly from the lower portion 46 of the cap 42 for cooperating with a corresponding circumferential groove (not shown) formed in the second end 18 of the base portion 12 to further ensure a good connection between the cap 42 and the base portion 12.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for attaching an electrical cable to and making an electrical connection with a mounting post on a vehicle battery, comprising:

a base portion having an aperture extending therethrough between a first end and a second end thereof, said first end sized to be placed over the mounting post;

an insert received in said second end of base portion, said insert operable to make an electrical connection with the mounting post;

a cap having an open end sized to receive said base portion and a closed end;

a spring received in said base and compressed between an upper surface of said insert and an interior surface of said closed end of said cap; and at least one stop member attached to said base portion, said stop member interacting with said cap to lock said cap in position with respect to said base when said spring is compressed, maintaining compression on said spring and urging said insert into contact with the mounting post to ensure the electrical connection between said insert and the mounting location.

2. The apparatus according to claim 1 including the electrical cable attached to said insert and extending from said apparatus for attachment to an electrical system.

3. The apparatus according to claim 1 wherein said insert is a split conical insert.

4. The apparatus according to claim 1 wherein said stop member interacts with a groove formed in an exterior surface of said cap.

5. The apparatus according to claim 4 wherein said groove extends at an angle between said closed end and said open end of said cap.

6. The apparatus according to claim 5 wherein said groove includes a locking portion at an end thereof.

7. The apparatus according to claim 4 wherein said groove extends substantially vertically between said closed end and said open end of said cap.

8. The apparatus according to claim 7 wherein said groove includes a locking portion at an end thereof.

9. The apparatus according to claim 1 wherein said stop member is releasably attached to said base portion.

10. A battery assembly for supplying electrical power to a vehicle electrical system, comprising:

a battery having at least one mounting post extending therefrom; and at least one attachment assembly including, a base portion having an aperture extending therethrough between a first end and a second end thereof, said first end sized to be placed over the at least one mounting post;

an insert received in said second end of base portion, said insert operable to make an electrical connection with the at least one mounting post;

a cable electrically connected to said insert at one end and to the vehicle electrical system at another end;

a cap having an open end sized to receive said base portion and a closed end;

a spring received in said base and compressed between an upper surface of said insert and an interior surface of said closed end of said cap; and at least one stop member attached to said base portion, said stop member interacting with said cap to lock said cap in position with respect to said base when said spring is compressed, maintaining compression on said spring and urging said insert into contact with the at least one mounting post to ensure the electrical connection between said insert and the at least one mounting post and a supply of electrical energy to the vehicle electrical system.

11. The assembly according to claim 10 wherein said at least one battery post extends outwardly from an upper surface of said battery.

12. The assembly according to claim 10 wherein said insert is a split conical insert.

13. The assembly according to claim 10 wherein said stop member interacts with a groove formed in an exterior surface of said cap.

14. The assembly according to claim 13 wherein said groove extends at an angle between said closed end and said open end of said cap.

15. The assembly according to claim 14 wherein said groove includes a locking portion at an end thereof.

16. The assembly according to claim 13 wherein said groove extends substantially vertically between said closed end and said open end of said cap.

17. The assembly according to claim 16 wherein said groove includes a locking portion at an end thereof.

18. The assembly according to claim 10 wherein said stop member is releasably attached to said base portion.

19. A battery assembly for supplying electrical power to a vehicle electrical system, comprising:

a battery having a pair of mounting posts extending from an upper surface thereof; and a pair of attachment assemblies, each of said attachment assemblies including, a base portion having an aperture extending therethrough between a first end and a second end thereof, said first end sized to be placed over a respective one of the mounting posts;

an insert received in said second end of base portion, said insert operable to make an electrical connection with the respective one of the mounting posts;

a cable electrically connected to said insert at one end and to the vehicle electrical system at another end;

a cap having an open end sized to receive said base portion and a closed end;

a spring received in said base and compressed between an upper surface of said insert and an interior surface of said closed end of said cap; and at least one stop member attached to said base portion, said stop member interacting with said cap to lock said cap in position with respect to said base when said spring is compressed, maintaining compression on said spring and urging said insert into contact with the at least one mounting post to ensure the electrical connection between said insert and the respective one of the mounting posts and a supply of electrical energy to the vehicle electrical system.

* * * * *